United States Patent [19]

Watanabe et al.

[11] Patent Number: 4,562,448

[45] Date of Patent: Dec. 31, 1985

[54] HEAT-SENSITIVE TRANSFER MEDIUM

[75] Inventors: Hideo Watanabe; Minoru Hakiri; Kanjirou Kawasaki, all of Numazu; Keishi Kubo, Yokohama; Nobuhiro Takigawa, Numazu, all of Japan

[73] Assignee: Ricoh Co., Ltd., Tokyo, Japan

[21] Appl. No.: 661,553

[22] Filed: Oct. 17, 1984

[30] Foreign Application Priority Data

Oct. 18, 1983 [JP] Japan ..... 58-194722

[51] Int. Cl.[4] ..... B41M 5/22

[52] U.S. Cl. ..... 346/208; 346/200; 346/207; 346/209; 346/226; 427/150; 427/151

[58] Field of Search ..... 346/200, 207, 208, 209, 346/226; 427/150, 151

[56] References Cited

U.S. PATENT DOCUMENTS 4,168,845 9/1979 Oeda et al. ..... 346/226

FOREIGN PATENT DOCUMENTS 0107884 7/1982 Japan ..... 346/200

*Primary Examiner*—Bruce H. Hess

*Attorney, Agent, or Firm*—Flynn, Thiel, Boutell & Tanis

[57] ABSTRACT

A heat-sensitive transfer medium of this invention comprises the combination of a transfer sheet which has on one surface of a substrate a transfer layer consisted essentially of a leuco dye and a binder resin and is provided on its opposite surface with a 0.2–5 μm-thick polyfluorocarbon-containing layer with a receiving sheet which is provided on the substrate with a receiving layer consisting essentially of a developer for the leuco dye and the binder resin, and further comprises adding a porous filler (oil absorption: 50–300 ml/100 g) to the receiving layer and/or the transfer layer.

4 Claims, No Drawings

HEAT-SENSITIVE TRANSFER MEDIUM

BACKGROUND OF THE INVENTION (a) Field of the Invention

The present invention relates to a heat-sensitive transfer medium utilizing a color-forming reaction between a leuco dye and a developer therefor, in more detail relates to a heat-sensitive transfer medium which is capable of producing a high density transfer image by the use of micro-energy and further producing uniform density transfer images even when the transfer operation is repeated a large number of times.

(b) Description of the Prior Art

As the conventional heat-sensitive transfer mediums, there are known the one comprising the combination of a transfer sheet made by providing a thermo-sublimating dye layer on a substrate with a receiving sheet, and the one comprising the combination of a transfer sheet made by providing a transfer layer containing a heat fusible substance such as fatty acid amide and a chromatogenous agent (dye or pigment) on a substrate with a receiving sheet. When actually forming images by the use of the heat-sensitive transfer medium of this type is carried out in the manner of superposing a receiving sheet on the surface of a heat fusible dye layer or transfer layer of a transfer sheet and heat-pressing with a printing means such as a thermal head, a thermal pen or the like from the back surface of said transfer sheet (the surface of said substrate) to thereby sublimation transfer said dye imagewise on said receiving sheet or fusion transfer the transfer layer imagewise on the receiving sheet.

However, the former heat-sensitive transfer medium using the thermo-sublimating dye in the receiving sheet is defective in that the dye image formed on the receiving sheet is inferior in preservability and therefore an over coat must be applied on the transfer image, while the latter heat-sensitive transfer medium using the transfer sheet having the transfer layer formed by dispersing the chromatogenous agent in the heat fusible substance is defective in that when a large amount of chromatogenous agent is incorporated in the transfer layer in order to obtain high density images, the efficiency of transfer deteriorates, and consequently it is difficult to obtain high density images, and further when a large amount of heat fusible substance is used in the transfer layer, said large amount of heat fusible substance transfer to the receiving sheet side, and consequently when stripping the transfer sheet and the receiving sheet, they are not stripped smoothly, the fine-lined up image area becomes indistinct and the like.

On the other hand, there is also known the heat-sensitive transfer medium wherein two kinds of substances such, for instance, as a leuco dye and a developer like a phenolic substance which thermally react each other to bring out the color, are carried on a separate substrate respectively by the use of aforesaid heat fusible substance to make-up a transfer sheet and a receiving sheet respectively, the transfer layer of the transfer sheet (the layer having carried a leuco dye thereon) and the receiving layer of the receiving sheet (the layer having carried a developer thereon) are superposed so that said both sheets may surface-contact, and thermoprinting is carried out from the back surface of the transfer sheet. However, the heat-sensitive transfer medium of this type can be observed defective in that due to its reactive type, a sufficient color-forming reaction can not be carried out in case the transfer layer is merely transferred to the receiving layer at the time when the surfaces of both layers contact, so that the low density images may be produced, and that in case the thermoprinting is carried out for a long period of time under the elevated heating condition, the image on the receiving sheet becomes more high density, but on the other hand the color-forming reaction progresses also on the transfer sheet thereby to form images.

SUMMARY OF THE INVENTION

The object of the present invention is to provide a heat-sensitive transfer medium which can produce a high density as well as stable transfer image even when micro-energy is applied and further can produce uniform image density due to transfer of a small amount of leuco dye component from a transfer layer to a receiving layer even when transfer is repeated a large number of times.

According to the present invention, there is provided a heat-sensitive transfer medium comprising the combination of a transfer sheet with a receiving sheet, said transfer sheet being built-up by forming on a substrate a transfer layer consisting essentially of a leuco dye and a binder resin, said receiving sheet being built-up by forming on a substrate a receiving layer consisting essentially of a developer for said leuco dye and a binder resin, wherein said receiving layer and/or transfer layer is added with a porous filler whose oil absorption is 50–300 ml/100 g and further on the surface opposite to the transfer layer of the transfer sheet there is formed a 2–5 μm-thick polyfluorocarbon-containing layer.

DETAILED DESCRIPTION OF THE INVENTION

The heat-sensitive transfer medium according to the present invention is built up, as usual, by superposing the transfer sheet and the receiving sheet which carry thereon two kinds of substances such as a leuco dye and a developer therefor which thermally react each other to bring out the color respectively so that said transfer layer and the receiving layer may surface-contact each other, wherein a desired developed color image is formed on the surface of the receiving sheet (the surface on the receiving layer side) by thermoprinting carried out from the back of the transfer sheet. In the present invention, however, as described above, the polyfluorocarbon-containing layer is formed on the back of the transfer sheet (the surface opposite to the transfer layer, whereby even if one and the same transfer sheet is used repeatedly a number of times, there is no possibility of the transfer sheet being damaged and so developed color images having a uniform density can be formed on the receiving sheet.

The polyfluorocarbon for use in the transfer sheet of the present invention is characterized in that it is superior in heat resisting property as compared with other resins. Referring to the thermoprinting apparatus for use in heat sensitive transferring, whilst, it is clear that its surface temperature becomes 200° C. or more, although for a short time. On the other hand, it was found that the superior results are obtained in the repeated use of the transfer sheet by covering the back of the transfer sheet with a polyfluorocarbon-containing layer. When a normal resin film is used as a substrate for a transfer sheet, it is defective in that even if a clear-cut image is obtained at the first transfer, after the repetition of a number of transfer the film is damaged and clear-cut images are difficult to obtain. In the case like this, the provision of a polyflourocarbon-containing layer on the back of the transfer sheet prevents the film from being damaged like this and further prevents the film from fusing to the thermal head, whereby a number of transfer can be carried out with ease. The polyfluorocarbon-containing layer can be formed by applying a polyfluorocarbon-containing solution or dispersion on the back of the transfer sheet by means of an optical coating method such as dip coating, wire bar coating, spray coating or the like. This polyfluorocarbon can be concurrently used together with other heat resisting resins. Referring to the thickness of this polyfluorocarbon-containing layer, when too thin, said layer is insufficient in heat resistance, and, when too thick, said layer is inferior in heat sensitivity. Accordingly, in the case of the present invention, said thickness desirably is 0.2–5 μm, preferably 0.5–3 μm.

As the polyfluorocarbon referred to herein, there are employed those having a melting point of 250° C. or more and placed on the market in the form of a solvent or a dispersion.

The transfer sheet used in the present invention is the one built-up in the manner of forming a transfer layer consisting essentially of a leuco dye and a binder resin on the surface of a substrate such as plastic film, paper or synthetic paper, in particular plastic film, said substrate being provided on the back with a polyfluorocarbon-containing layer. As the leuco dye referred to herein, there may be employed any one which has usually been used in the pressure sensitive paper or heat sensitive paper, for instance those of triphenylmethane system, fluoran system, phenothiozine system. Auramine system and spiropyran system are suitably used. The concrete examples of these leuco dyes are shown hereinafter:

3,3-bis(p-dimethylaminophenyl)-phthalide,
3,3-bis(p-dimethylaminophenyl)-6-dimethylaminophthalide (another name: Crystal Violet lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-{N-(3'-trifluoromethylphenyl)amino}-6-diethylaminofluoran,
2-{3,6-bis(diethylamino)-9-(o-chloroanilino)xanthyl benzoic acid lactam},
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran, benzoyl leuco Methylene Blue
6'-chloro-8'-methoxy-benzoindolino-pyrylospyran,
6'-bromo-3'-methoxy-benzoindolino-pyrylospyran,
3-(2'-hydroxy-4'-diethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diehtylaminophenyl)-3-(2'-methoxy-5'-methylphenyl) phthalide, and
3-(2'-methoxy-4'-dimethylaminophenyl)-3-(2'-hydroxy-4'-chloro-5'-methylphenyl)phthalide.

In this connection, it is to be noted that the binder resins used in the transfer layer will be referred to afterwards.

The receiving sheet used in the present invention comprises forming the receiving layer consisting essentially of the developer for said leuco dye and the binder resin on the substrate such as paper, synthetic paper, plastic film or the like. As the developer, in this instance, there is applicable an electron-receiving substance, for instance a phenolic substance, an organic acid or its salt or ester or the like. From the practical view point, the electron-receiving substance having a melting point of 200° C. or less is preferably applicable. The concrete examples of developers used preferably in the present invention are shown below. In this connection, it is to be noted that the numerals enchlosed with brackets denote melting points.

4-tert-butylphenol (98), 4-hydroxydiphenyl ether (84), 1-naphthol (98), 2-naphthol (121), methyl 4-hydroxy benzoate (131), 4-hydroxy acetophenone (109), 2,2'-dihydroxydiphenyl ether (79), 4-phenyl phenol (166), 4-tert-octylcatechol (109), 2,2'-dihydroxydiphenyl (103), 4,4'-methylene-bisphenol (160), 2,2'-methylenebis(4-chlorophenol) (164), 2,2'-methylenebis(4-methyl-6-tert-butylphenol) (125), 4,4'-isopropylidenediphenyl (156), 4,4'-isopropylidene-bis(2-chlorophenol) (90), 4,4'-isopropylidenebis(2,6-dibromophenol) (172), 4,4'-isopropylidene-bis(2-tert-butylphenol (110), 4,4-isopropylidene-bis(2-methylphenol) (136), 4,4'-isoprophylidene-bis(2,6-dimethylphenol) (168), 4,4'-secbutylidene-diphenol (119), 4,4'-sec-butylidene-bis(2-methylphenol) (142), 4,4'-cyclohexylidene-diphenol (180), 4,4'-cyclohexylidene-bis(2-methylphenol) (184), solicylic acid (163), metatolyl salicylate (74), phenacyl salicylate (110), methyl 4-hydroxybenzoate (131), ethyl 4-hydroxybenzolate (116), propyl 4-hydroxybenzoate (98), isopropyl 4-hydroxybenzoate (86), butyl 4-hydroxybenzoate (71), isoamyl 4-hydroxybenzoate (50), phenyl 4-hydroxybenzoate (178), benzyl 4-hydroxybenzoate (111), cyclohexyl 4-hydroxybenzoate (119), 5-hydroxysalicylic acid (200), 5-chlorosalicylic acid (172), 3-chloro salicylic acid (178), thiosalicylic acid (164), 2-chloro-5-nitrobenzoic acid (165), 4-methoxyphenol (53), 2-hydroxy-benzylalcohol (87), 2,5-dimethylphenol (75), benzoic acid (122), orthotoluic acid (107), metatoluic acid (111), paratoluic acid (181), orthochlorobenzoic acid (142), metaoxybenzoic acid (200), 2,4-dihydroxy-acetophenone (97), resorcinol monobenzoate (135), 4-hydroxybenzophenone (133), 2,4-dihydroxybenzophenone (144), 2-naphthoic acid (184), 1-hydroxy-2-naphthoic acid (195), ethyl 3,4-dihydroxybenzoate (128), phenyl 3,4-dihydroxybenzoate (189), 4-hydroxypropiophenone (150), salicylsalicylate (148) and monobenzyl phthalate (107).

In addition, the present invention can use, as the developers, the phenolic compounds represented by the general formula:

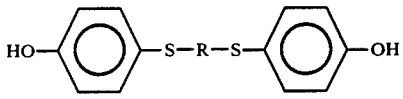

(1)

(Wherein, R stands for an alkylene group containing 1–5 ehter linkages). This phenolic substance can be synthesized in a large yield, high purity and at a relatively cheap price by reacting mono-thiohydroquinone with its corresponding dihalogenoalkyl ether under alkaline conditions.

In the phenolic substance represented by said general formula, R denotes the alkylene group containing 1–5 ether radicals, but in this case, said ether radical may be present on the main chain of the alkylene group or may be present on the side chain. The number of carbons contained in the ether radical-containing alkylene group is normally in the range of 2–15. The ether radical-containing alkylene group preferably contains 1–3 ether linkages and has 2–7 carbon atoms.

In this connection, the binder resin used in the receiving layer will be referred to afterwards.

In the case of the present invention, said receiving layer and/or transfer layer is added with a porous filler, whose oil absorption is 50–300 ml/100 g (according to JIS K5101 method), preferably 150–300 ml/100 g, in order to make the receiving layer/or transfer layer carry out a sufficient color forming-reaction for obtaining a high density image. In the case of incorporating said filler in the receiving layer, its amount is in the range of 0.01–10 wt. parts, preferably 0.1–3 wt. parts, based on 1 wt. part of the developer. In the case of incorporating said filler in the transfer layer, while, its amount is 0.01–1 wt. part, preferably 0.03–0.5 wt. part against 1 wt. part of leuco dye. As the concrete examples of the porous filler, there can be enumerated inorganic and organic fine powder of silica, aluminum silicate, alumina, aluminum hydroxyde, magnesium hydroxide, urea-formaldehyde resin, styrene resin and the like. In the present invention, furthermore, it is possible to add a heat-fusible substance having a melting point of 50°–200° C., preferably 50°–150° C., to the transfer layer and/or the receiving layer for the purpose of enhancing the heat sensitivity. The amount of said substance used is 0.1–50 wt. parts based on 1 wt. part of leuco dye.

The heat-fusible substances suitably used in the present invention can be shown as follows:

(1) Fatty acid amides represented by the following general formula (I) or (II)

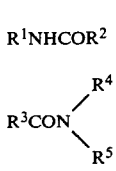

(I)

(II)

(wherein, $R^2$ stands for an alkyl group having 1–30 carbon atoms, $R^1$ and $R^3$ each stands for an alkyl group having 10–30 carbon atoms, and $R^4$ and $R^5$ each stands for hydrogen or a lower alkyl group).

As the concrete examples of the above mentioned fatty acid amides there can be enumerated as follows.

decylacetamide, decylpropionamide, undecylacetamide, undecylpropionamide, laurylacetamide, laurylpropionamide, tridecylscetamide, tridecylpropionamide, myristylacetamide, myristylpropionamide, pentadecylacetamide, pentadecylpropionamide, palmitylacetamide, palmitylpropionamide, palmitylbutylamide, heptylacetamide, heptylpropionamide, stearylacetamide, stearylpropionamide, stearylbutylamide, stearylvaleramide, stearylcapronamide, stearyllaurinamide, stearylpalmitinamide, stearylstearinamide, nonadecylacetamide, nonadecylpropionamide, behenylacetamide, behenylpropionamide, behenylstearinamide, undecanic methylamide, undercanic ethylamide, lauric methylamide, lauric ethylamide, tridecanoic methylamide, tridecanoic ethylamide, myristic methylamide, myristic ethylamide, pentadecanoic methylamide, pentadecanoic ethylamide, palmitic methylamide, palmitic dimethylamide, palmitic butylamide, stearic methylamide, stearic ethylamide, stearic propylamide, stearic butylamide, stearic dimethylamide, stearic diethylamide, stearic dibutylamide, nonadecanoic methylamide, nonadecanoic ethylamide, behenic methylamide, oleic methylamide and oleic ethylamide.

(2) Aromatic carboxylic acid amides represented by the following general formula (III):

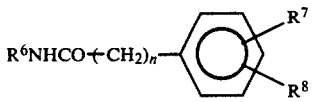

(III)

(wherein, $R^6$ stands for an alkyl group having 1–30 carbon atoms, $R^7$ and $R^8$ each stands for hydrogen, halogen, a lower alkyl group or lower alkoxy group, and n is 0 or 1).

As the concrete examples of the above mentioned compounds, there can be enumerated as follows.

N-stearyl benzamide, N-palmityl-2-chlorobenzamide, N-stearyl-2-methoxybenzamide, N-stearyl-4-methylbenzamide, N-palmityl-2,4-dimethylbenzamide, N-behenylbenzamide, N-behenyl-2-methyl-benzamide, N-stearylphenylacetylamide and N-behenylphenylacetylamide.

(3) Amides having cyclohexyl rings represented by the following general formulas (IV) and (V):

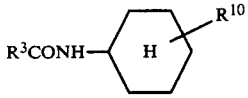

(IV)

(wherein, $R^3$ stands for an alkyl group or a substituted or unsubstituted aryl group having 1–30 carbon atoms and $R^{10}$ stands for hydrogen, halogen or a lower alkyl group).

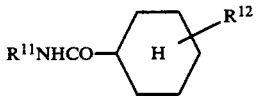

(V)

(wherein, $R^{11}$ stands for an alkyl group having 1–30 carbon atoms, and $R^{12}$ stands for hydrogen, halogen or a lower alkyl group).

As the concrete examples of such conpounds, there can be enumerated for instance those as shown below.

N-cyclohexylacetamide, N-cyclohexylpropionamide, N-cyclohexyl stearic acid amide, N-cyclohexylbenzamide, N-cyclohexyl-2-methylbenzamide, N-cyclohexyl-2-chlorobenzamide, N-cyclohexyl-2,4-dimethylbenzamide, N-cyclohexylpalmitic acid amide, N-(chlorohexyl)palmitic acid amide, N-(2-methylcyclohexyl)stearic acid amide, and N-stearylhexahydrobenzamide.

(4) Phenyl esters of hydroxybenzoic acid represented by the following general formula (VI):

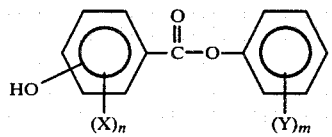

(VI)

(wherein, X stands for halogen, an alkyl group or an alkoxy group having 1–30 carbon atoms, a halogen-substituted or unsubstituted aryl group or aralkyl group, a substituted or unsubstituted aryloxy or aralkyloxy group or a carboxyl group or hydroxyl group, n is 0, 1, 2 or 3, and m is 1, 2 or 3).

As the concrete examples of such compounds, there can be enumerated for instance those as shown below.

phenyl-4-hydroxybenzoate, 2-methoxyphenyl 4-hydroxybenzoate, 2-methoxy-4-methylphenyl 4-hydroxybenzoate, 3,5-dioxyphenyl 4-hydroxybenzoate, 4-carboxyphenyl 3-hydroxybenzoate, 4-butoxyphenyl 4-hydroxybenzoate, 4-chlorophenyl 4-hydroxybenzoate, 4-chlorophenyl 4-hydroxybenzoate, 2-chlorophenyl salicylate, 4-chlorophenyl salicylate, 2,3-dichlorophenyl salicylate, 2,6-dichlorophenyl salicylate, 2,4,6-trichlorophenyl salicylate, 2-bromophenyl salicylate, 4-bromophenyl salicylate, 2,4-dibromophenyl salicylate, 2,6-dibromophenyl salicylate, 2,4,6-tribromophenyl salicylate, 3-methylphenyl salicylate, 2,4-dimethylphenyl salicylate, 4-tertiary-butylphenyl salicylate, 4-tertiaryamylphenyl salicylate, 2-methoxyphenyl salicylate, 2-ethoxyphenyl salicylate, 3-methoxyphenyl salicylate, 4-hydroxyphenyl salicylate, 4-benzylphenyl salicylate, 4-benzoylphenyl salicylate, 2-methoxy-4-allylphenyl salicylate, α-naphthyl salicylate, β-naphthyl salicylate, 4-chloro-3-methylphenyl salicylate, 3-hydroxyphenyl salicylate, 4-propenylphenyl salicylate, 3-methylphenyl 5-chlorosalicylate, and 2-methoxyphenyl 3,5-dichlorosalicylate.

(5) Phenyl esters of benzoic acid represented by the following general formula (VII):

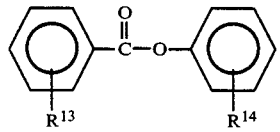

(VII)

(wherein $R^{13}$ stands for hydrogen an alkyl group or alkoxy group having 1–30 carbon atoms, halogen, a nitro group, a nitrile group, an acyloxy group, a substituted or unsubstituted aryl or aralkyl group, or a substituted or unsubstituted aryloxy or alkyloxy group, and $R^{14}$ stands for hydrogen, an alkyl group or alkoxy group having 1–30 carbon atoms, halogen, a nitro group, a nitrile group, an acyloxy group, a substituted or unsubstituted aryl or aralkyl group, a substituted or unsubstituted aryloxy or aralkyloxy group or a an acyl group).

As the concrete examples of such compounds, there can be enumerated for instance those as shown below.

Phenyl benzoate, 4-methylphenyl benzoate, 2,4-dichlorophenyl benzoate, 2,4,6-trichlorophenyl benzoate, 2-methyl-4-chlorophenyl benzoate, 3-bromophenyl benzoate, 4-nitrilephenyl benzoate, 2,4-dibromophenyl benzoate, 3-iodophenyl benzoate, 3-nitrophenyl benzoate, 4-methyl-2,6-dichlorophenyl benzoate, 4-isopropylphenyl benzoate, 4-t-butylphenyl benzoate, 4-benzylphenyl benzoate, 4-(1-naphthyl)phenyl benzoate, 2-benzoyloxyphenyl benzoate, 4-(2-methyl)diphenyl benzoate, 2-phenylethyloxyphenyl benzoate, 2-acetoxyphenyl benzoate, 4-methoxyphenyl benzoate, 4-(4-methyl)phenoxy phenyl benzoate, phenyl 4-methyl benzoate, phenyl 4-methoxybenzoate, phenyl 4-phenoxybenzoate, phenyl 4-acetoxybenzoate, 4-methoxyphenyl 4-methoxybenzoate, phenyl 2-acetoxybenzoate, phenyl 2-benzoyloxybenzoate, 4-methylphenyl 2-nitrobenzoate, 4-methylphenyl 4-nitrobenzoate, 4-benzoyloxybenzophenone, and 2-benzoinoxy-4-methylbenzophenone.

(6) Esters of benzoyloxybenzoic acid represented by the following general formula (VIII):

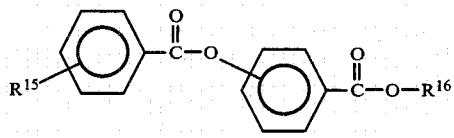

(VIII)

(wherein, $R^{15}$ stands for hydrogen, an alkyl group or an alkoxy group having 1–30 carbon atoms or halogen, and $R^{16}$ stands for an alkyl group having 1–30 carbon atoms, a substituted or unsubstituted aryl or aralkyl group).

As the concrete examples of such compounds, there can be enumerated for instance those as shown below.

methyl 4-benzoyloxybenzoate, ethyl 4-benzoyloxybenzoate, n-propyl 4-benzoyloxybenzoate, benzyl 4-benzoyloxybenzoate, phenyl 4-benzoyloxybenzoate, phenyl 2-benzoyloxybenzoate, ethyl 4-(4'-methylbenzoyloxy)benzoate, ethyl 4-(4'-methoxybenzoyloxy)benzoate, ethyl 4-(4'-chlorobenzoyloxy)benzoate.

As the binders usable in the transfer layer and the receiving layer, there can be enumerated the usual ones such, for instance, as water-soluble, organic solvent soluble or water emulsion-forming binders including, for instance, polyvinyl alcohol, methoxycellulose, hydroxyethylcellulose, carboxymethylcellulose, polyvinylpyrrolidone, polyacrylamide, polyacrylic acid, starch, gelatin, polystyrene, vinyl chloride-vinyl acetate copolymer, polybutylmethacrylate and the like. In the case of the transfer layer, it is particularly preferable to use the resins having a melting or softening point of 50°–130° C., for instance, such as polyethylene, polypropyrene, polystyrene, petroleum resin, acrylic resin, vinyl chloride resin, vinyl acetate resin, vinylidene chloride resin, polyvinylalcohol, cellulose resin, polyamide, polyacetal, polycarbonate, polyester, fluorin-contained resin, silicone resin, natural rubber, chlorinated rubber, butadiene rubber, olefin rubber, phenol resin, urea resin, melamine resin, epoxy resin, polyimide and the like.

These resins are used suitably in the form of homopolymers, copolymers or mixtures of plural resins, in particular it is preferable to use those resins whose SPValue (solubility parameter) is 8 or more, more preferably 9 or more. Said SPValue denotes a solubility parameter of a resin, and is represented by the following formula:

$$SPValue\ [(Cal/cc)^{\frac{1}{2}}]=(E-V)^{\frac{1}{2}}$$

E: coagulant energy density (Cal/mole) of resin
V: molar volume (cc/mole).

The suitable amount of the binder used in the transfer layer is about 0.01–1 wt. part per wt. part of the leuco dye, and said amount used in the receiving layer is about 0.01–1 wt. part per wt. part of the developer.

As the substrate for the transfer sheet and the receiving sheet there are used paper, plastic film, synthetic paper and the like.

The heat-sensitive transfer medium of the present invention is generally prepared in the manner of preparing for a solution for forming each of the transfer layer and the receiving layer by dispersing and dissolving each component of the transfer layer and the receiving layer, (said dispersion may be emulsion-like when water is used), using a grinding and mixing means such as a ball mill, a sand mill or the like, applying the solution uniformly onto each substrate and drying so that the dry adhesion amount may be 0.3–30 g/m$^2$, and thus forming each of the transfer layer or the receiving layer. Referring to the coating method, another one such as hot-melt coating method can be used. In the case of forming the transfer layer, this forming solution (the hot-melt in the case of using the hot-melt coating method) may be coated uniformly on the substrate as aforesaid to thereby form the so-called plain cloth-like (none-image-wise) transfer layer, but it is also possible to form an image-wise transfer layer by making a desirable imagewise coating. In addition, as the method for actually forming an imagewise transfer layer there can be enumerated the one which comprises printing this forming solution imagewise suitably on a substrate by means of the printing method such as letterpress printing or gravure, or beforehand forming a transfer sheet having a non-imagewise transfer layer as described above and then superposing a proper substrate on the surface of this transfer layer, and heat-pressing the same from the back (substrate) surface of the transfer sheet by means of a thermal-head or thermal-pen to thereby fusion transfer the transfer layer compositions onto said substrate.

In the above-mentioned process of preparing a heat-sensitive transfer medium, when a heat fusible substance is used for the purpose of enhancing the heat sensitivity and the conventional method (solution or emulsion coating method, it is profitable that at the time of forming the transfer layer or the receiving layer or after the formaiton thereof, this layer is subjected to heat treatment with a temperature more than the melting point of the heat fusible substance to thereby once fuse the heat fusible substance. In case where the same conventional method has been employed, it is also preferable to utilize a coating liquid containing the leuco dye in the state of fusion. It is also effective to control the surface smoothness (Beckmann's smoothness JIS-P8119) of the transfer layer and/or receiving layer to be in the range of 200–10000 seconds.

On effecting the heat-sensitive operation using, for instance, a transfer sheet having an image-wise transfer layer, both sheets are superposed so that the receiving layer of the receiving sheet surface contacts with the transfer layer of the transfer sheet and the thus superposed sheets are passed through heating rollers, while on effecting the heat-sensitive operation using a transfer sheet having a non-imagewise transfer layer, it may be done by superposing a receiving layer surface of a receiving sheet on a transfer layer of a transfer sheet and putting a thermal head or thermal pen attached to a thermal printer on the back of the thermal sheet, thereby heat-printing directly thereon.

The heat-sensitive transfer according to the present invention can obtain a multiplicity of copies can be obtained readily by repeating the above-mentioned operation using the same transfer sheet. When intending to obtain multicolor copies, it can be achieved by preparing transfer sheets consisting essentially of different color-forming leuco dyes (preparing for instance a transfer sheet consisting of a blue color-forming leuco dye and a transfer sheet consisting of a red color-forming leuco dye), and forming transfer images on the same receiving sheet by transferring, whereby blue and red developed images can be formed on the same sheet.

According to the present invention, the leuco dye and the developer therefor are incorporated in different substrates and therefore the problem of developing fog caused at the monufacturing time and during the storage can be eliminated entirely, said problem having frequently be observed in the conventional heat-sensitive papers, and further the obtained copies, if heated, has no possibility of developing color (that is, completely stable copies) because the non-image areas of the obtained copies contain the developer alone but do not contain the leuco dye. Still further, the transfer sheet, which is superior in thermal resistance and mold release, has no possibility of being damaged on transferring. In addition, as the transfer sheet has no possibility of being fused to the thermal head, the use of the same transfer sheet can obtain a plurality of copies economically. The copies obtained in this instance are uniform in image density because transfer of the leuco dye from the transfer layer of the transfer sheet to the receiving layer of the receiving sheet is uniform and the dye is transferred little by little on transferring.

DESCRIPTION OF THE PREFERRED EMBODIMENTS

The present invention will be more detailed with reference to Examples.

EXAMPLE 1

A polyfluorocarbon coating agent (placed on the market as a fluorine system mold releasing agent: Lumiflon LF200 produced by Asahi Glass K.K.) was applied on a 6 μ-thick polyester film by means of a wire bar, and same was heat-treated at 120° C. for 10 minutes to thereby form a 0.5 μm-thick polyfluorocarbon layer.

Next, a composition consisting of 10 parts of 3-N-methyl-N-cyclohexylamino-6-methyl-7-anilinofluorane, 2 parts of vinyl chloride resin and 100 parts of methyl ethyl ketone was dispersed for 24 hours by means of a ball mill. Then, this dispersion was applied on the back of the polyfluorocarbon layer by means of a wire bar and dried to thereby prepare a transfer sheet having a transfer layer (adhesion amount 4 g/m$^2$).

On the other side, a composition consisting of 20 parts of n-butyl 4-hydroxybenzoate, 10 parts of silica fine powder (oil absorption 200 ml/100 g), 3 parts of polyvinyl alcohol and 100 parts of water was dispersed for 24 hours by means of a ball mill. Then, this dispersion was applied on the surface of a wood free paper (35 g/m$^2$) by means of a wire bar and dried to thereby prepare a receiving sheet having a receiving layer (adhesion amount: 5 g/m$^2$).

The surface of the transfer layer of the transfer sheet was superposed on the surface of the receiving layer of the thus prepared receiving sheet, and 1 m J of heating energy was given from the polyfluorocarbon layer side by means of a thermal head. In this instance, it was observed that the transfer sheet was not attached by fusion to the thermal head and was not also damaged, and a clear-cut black image (image density: 1.23) was produced on the receiving sheet. Even when the above mentioned operation was repeated 10 times, the transfer sheet was not damaged, and the image formed on the receiving sheet 10 times was clear-cut and showed the image density of 1.12. For comparison, next, there was prepared a transfer sheet according to the exactly same procedures except that the polyfluorocarbon layer was not provided the above mentioned receiving layer of the receiving sheet was superposed on said transfer layer, and 1 m J of heating energy was given from the transfer sheet side. As a result, the transfer sheet was attached by fusion to the thermal head, and was damaged completely. It proved impossible to carry out the transfer operation a number of times.

EXAMPLE 2

A polyfluorocarbon coating agent Fluorad FC-721 produced by Sumitomo 3M K.K.) was applied on a 6 μm-thick polyester film by means of a wire bar, and same was dried at room temperatures to thereby prepare a 1.0 μm-thick polyfluorocarbon layer.

Next, a transfer layer was provided on the back of this polyfluorocarbon layer according to the same procedure as Example 1. Thus, a transfer sheet was prepared.

The surface of the receiving layer of the receiving sheet used in Example 1 was superposed on the surface of the transfer layer of this transfer sheet and 0.9 m J of heating energy was given from the side of the polyfluorocarbon layer side of the transfer sheet by means of a thermal head. Thus, a black clearcut image (image density:1.20) was obtained. When the above mentioned operation was repeated 10 times, it showed that the image obtained 10 times on the receiving sheet has an image density of 1.12 and the transfer sheet was entirely free from any damage and any fusion.

EXAMPLE 3

A fluorine system mold releasing agent (Daifree MS44 produced by Daikin Industries) as a polyfluorocarbon coating agent was applied on a 9 μm-thick polyester film by means of a wire bar and dried to thereby form a 0.6 μm-thick polyfluorocarbon layer. Next, on the back of this polyfluorocarbon layer there was applied a dispersion, consisting of 15 g of Crystal Violet lactone, 1 g of silica fine powder (oil absorption: 300 ml/100 g), 2 g of polyester resin [poly(ε-caprolactam)] (molecular weight: 70000, melting point: 61° C.) and 100 g of methyl ethyl ketone and having been dispersed for 24 hours by means of a ball mill, by means of a wire bar to thereby prepare a transfer sheet having a transfer layer (adhesion amount: 4 g/m$^2$). On the surface of the transfer layer of this transfer sheet there was superposed the surface of the receiving layer of the receiving sheet used in Example 2, and 1 m J of heating energy was given from a thermal head for carrying out the same operation as Example 2. As a result, it was found that the image density of the image obtained at the first time was 1.12, the image density of the image obtained 10 times was 1.10, and the transfer sheet was not only damaged but also was not attached by fusion to the head when subjected to the 10th operation.

We claim:

1. A heat-sensitive transfer medium comprising the combination of a transfer sheet with a receiving sheet, said tranfer sheet being built-up by forming on a substrate a transfer layer consisting essentially of a leuco dye and a binder resin, said receiving sheet being built-up by forming on a substrate a receiving layer consisting essentially of a developer for said leuco dye and a binder resin, wherein said receiving layer and/or transfer layer is added with a porous filler whose oil absorption is 50–300 ml/100 g and further on the surface opposite to the transfer layer of the transfer sheet there is formed 0.2–5 μm-thick polyfluorocarbon-containing layer.

2. A heat-sensitive transfer medium according to claim 1 wherein the amount of the binder contained in the transfer layer and the amount of the porous filler contained in the transfer layer are 0.01–1 wt. part and 0.01–1 wt. part respectively per 1 wt. part of the leuco dye, while the amount of the binder contained in the receiving layer and the amount of the porous filler contained in the receiving layer are 0.01–1 wt. part and 0.01–10 wt. parts respectively per 1 wt. part of the developer.

3. A heat-sensitive transfer medium according to claim 1 wherein the adhesion amounts of the transfer layer and the receiving layer are each 0.3–30 g/m$^2$.

4. A heat-sensitive transfer medium according to claim 1 wherein the transfer layer and/or the receiving layer is further added with a thermo-fusible substance whose melting point is in the range of 50°–200° C.

* * * * *